United States Patent [19]

Shannon

[11] Patent Number: 4,877,236

[45] Date of Patent: Oct. 31, 1989

[54] ROTATING PLAYGROUND EQUIPMENT ASSEMBLY

[75] Inventor: William H. Shannon, Mentone, Ala.

[73] Assignee: Game Time, Inc., Ft. Payne, Ala.

[21] Appl. No.: 681,587

[22] Filed: Dec. 14, 1984

[51] Int. Cl.[4] ..... A63G 1/12

[52] U.S. Cl. ..... 272/33 R

[58] Field of Search ..... 272/33 R, 33 A, 33 B, 272/30, 50, 51, 28 R, 28 S, 39, 46, 47, 48, 73, 132, DIG. 4, 146, DIG. 9; 188/83, 60, 166, 74

[56] References Cited

U.S. PATENT DOCUMENTS

| | | | |
|---|---|---|---|
| 555,338 | 2/1896 | Rodehafer | 272/33 R |
| 575,624 | 1/1897 | Weston | 272/33 R |
| 896,407 | 8/1908 | Mayette | 272/33 R |
| 1,654,231 | 12/1927 | Akers | 272/33 R |
| 2,043,977 | 6/1936 | Back | 272/73 |
| 2,693,958 | 11/1954 | Ellenberger | 272/39 X |
| 3,073,595 | 1/1963 | Jones | 272/50 X |
| 3,595,570 | 7/1971 | Huff | 272/33 |
| 3,612,518 | 10/1971 | Bennett | 272/33 R |
| 3,702,188 | 11/1972 | Phillips et al. | 272/57 |
| 3,784,193 | 1/1974 | Simjian | 272/68 |
| 4,091,907 | 5/1978 | Tabler | 188/80 X |
| 4,505,476 | 3/1985 | Rubin | 272/DIG. 9 |

FOREIGN PATENT DOCUMENTS

| | | | |
|---|---|---|---|
| 123443 | 6/1931 | Austria | 272/50 |
| 1332044 | 10/1973 | United Kingdom | 188/80 |
| 2133996 | 8/1984 | United Kingdom | 272/28 R |

*Primary Examiner*—Robert A. Hafer
*Assistant Examiner*—S. Little
*Attorney, Agent, or Firm*—Welsh & Katz, Ltd.

[57] ABSTRACT

A rotating user-propelled playground equipment assembly or whirl including an equipment support base, a spindle secured to the support base, a rotatable platform assembly supported at least in part by the support base. The rotatable platform assembly includes a hub assembly rotatable about the spindle. A pressure wheel is positioned to constantly rollingly engage the hub assembly. A compression spring urging mechanism is connected to the pressure wheel and urges the pressure wheel into rolling engagement with the hub assembly and thereby automatically retards the rotation of the rotatable platform assembly about the spindle.

31 Claims, 6 Drawing Sheets

ROTATING PLAYGROUND EQUIPMENT ASSEMBLY

BACKGROUND OF THE INVENTION

This invention relates to playground, school and park equipment and more particularly to rotating playground equipment such as user-propelled merry-go-rounds or "whirls".

In the prior art, there have been developed numerous styles and designs of whirls. These typically have a circular occupant-supporting platform positioned a distance above the ground either level or at a slight angle and of large enough dimensions to support two or more children. They typically have handles or handholds which the user can grasp as he runs on the ground around the support platform thereby rotating the platform about its vertical axis. When the platform reaches the desired rotational speed, the user can then hop onto the platform and together with the other occupants is propelled around with it. Alternatively, the platform can be mounted at an angle and the whirl caused to turn in both a circular and a vertical motion by the occupant merely shifting his weight while seated in its tub shape. Another variation is the so-called "Pull-A-Round" device wherein one child or a group of children can turn the platform by pulling on a stationary center wheel.

These whirls have given pleasure to children for many years. However, problems are present in that the whirls can be caused to turn at too great a speed. This can happen when a plurality of athletic children are simultaneously propelling the machine or when one or more very strong children or teenagers are propelling it. This can be dangerous in that the children may be propelled off of the platform by its centrifugal force or, when trying to disembark while it is rotating, they may be injured. Further, the speeds may be so great that the children are frightened. Also, recent designs have been so efficient that the whirl will continue to turn for unduly great lengths of time. The children occupants can become frustrated or scared as they cannot disembark for many minutes. Also, the unreasonably long self-rotation period results in longer rotating sessions for each group of children, which means that fewer children can enjoy the whirl since the waiting time is longer.

Accordingly, it is the principal object of the present invention to provide an improved piece of rotating playground equipment.

Another object of the present invention is to provide an improved design of rotating playground equipment which is safer and helps prevent accidents.

A further object of the present invention is to provide an improved piece of rotating playground equipment including means for limiting its turning speed.

A still further object of the present invention is to provide an improved piece of rotating playground equipment which includes means for increasing the effort required to turn the unit.

Another object is to provide a novel piece of rotating playground equipment that includes a means for rapidly slowing the rotation of the unit after the rotating forces have ceased.

Other objects and advantages of the present invention will become more apparent to those persons having ordinary skill in the art to which the present invention pertains from the following description taken in conjunction with the accompanying drawings.

DETAILED DESCRIPTIONS OF THE PREFERRED EMBODIMENTS

Figure 1:
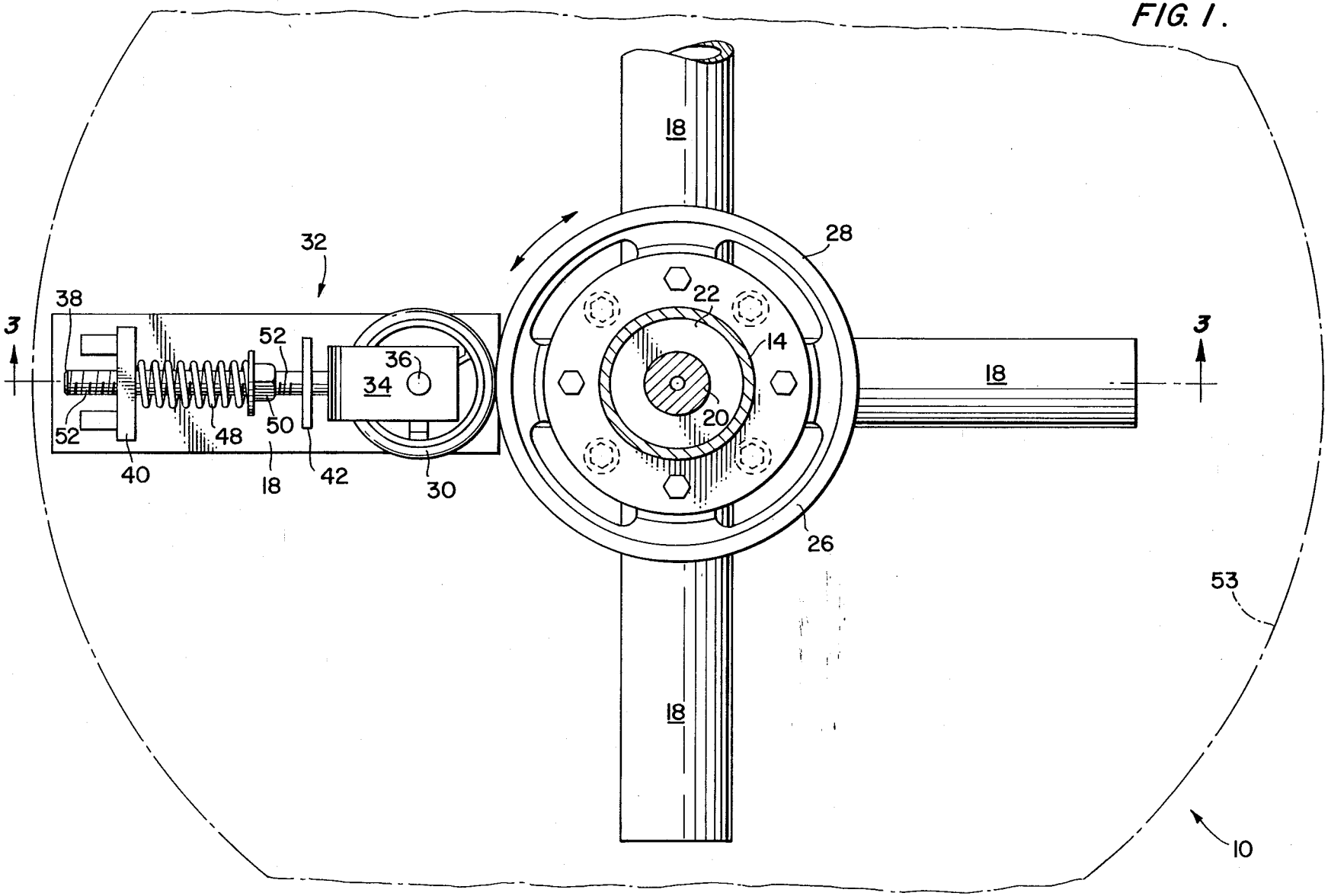
FIG. 1 is a fragmentary top plan view of one embodiment of the present invention for a rotating playground equipment assembly.
Figure 2:
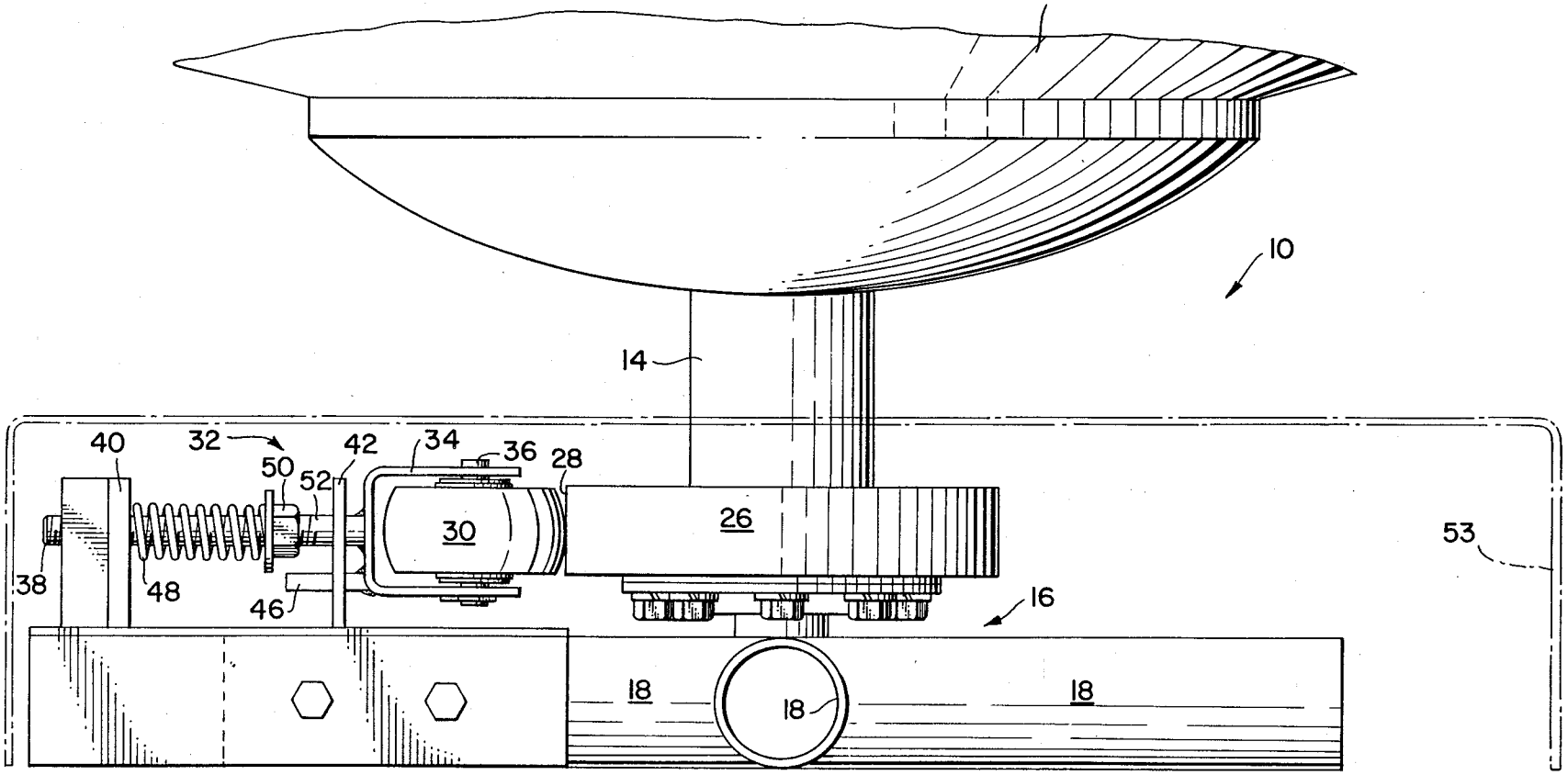
FIG. 2 is a fragmentary side elevational view of the assembly of FIG. 1.
Figure 3:
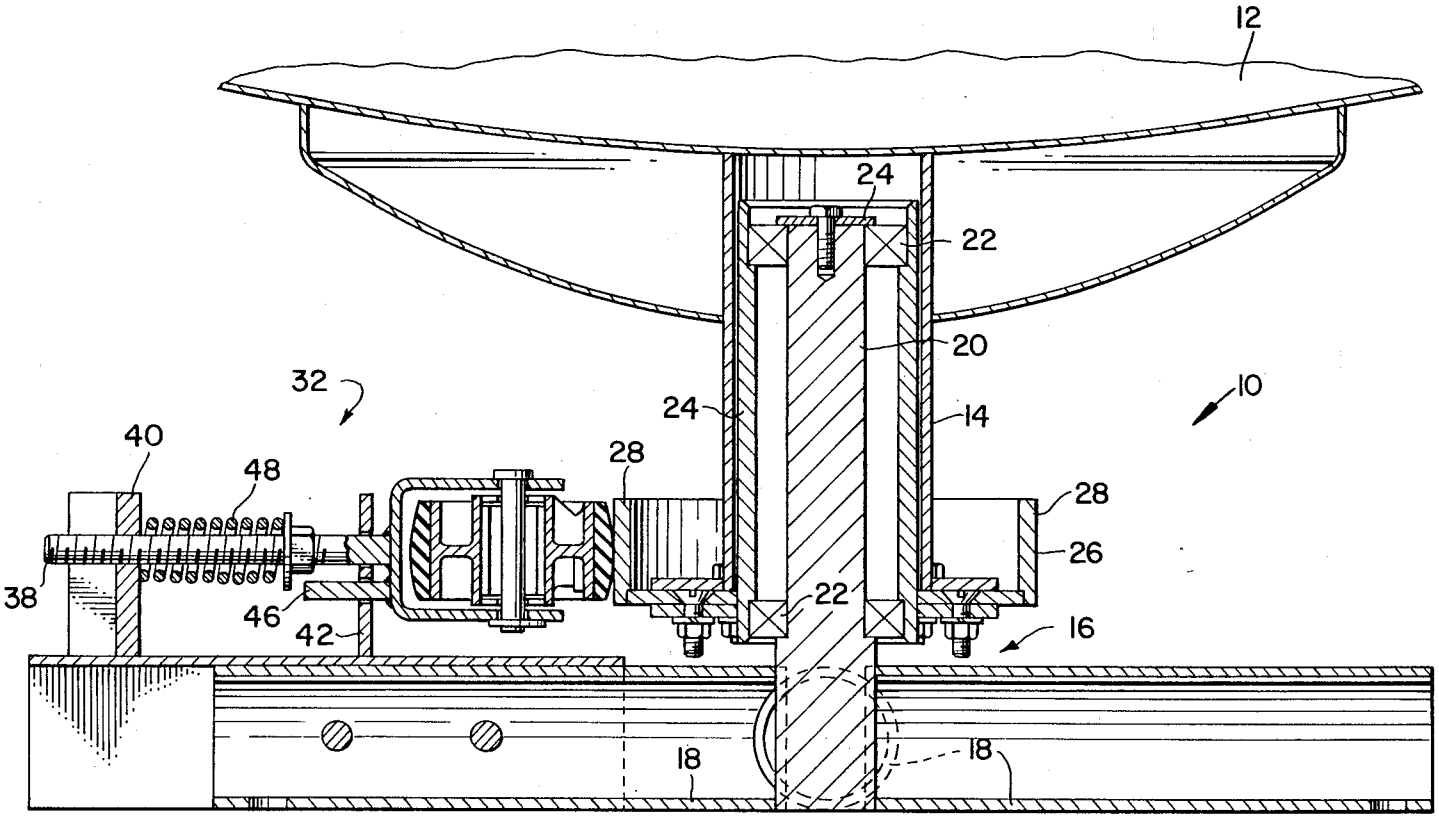
FIG. 3 is a cross-sectional view taken along line 3—3 of FIG. 1.
Figure 4:
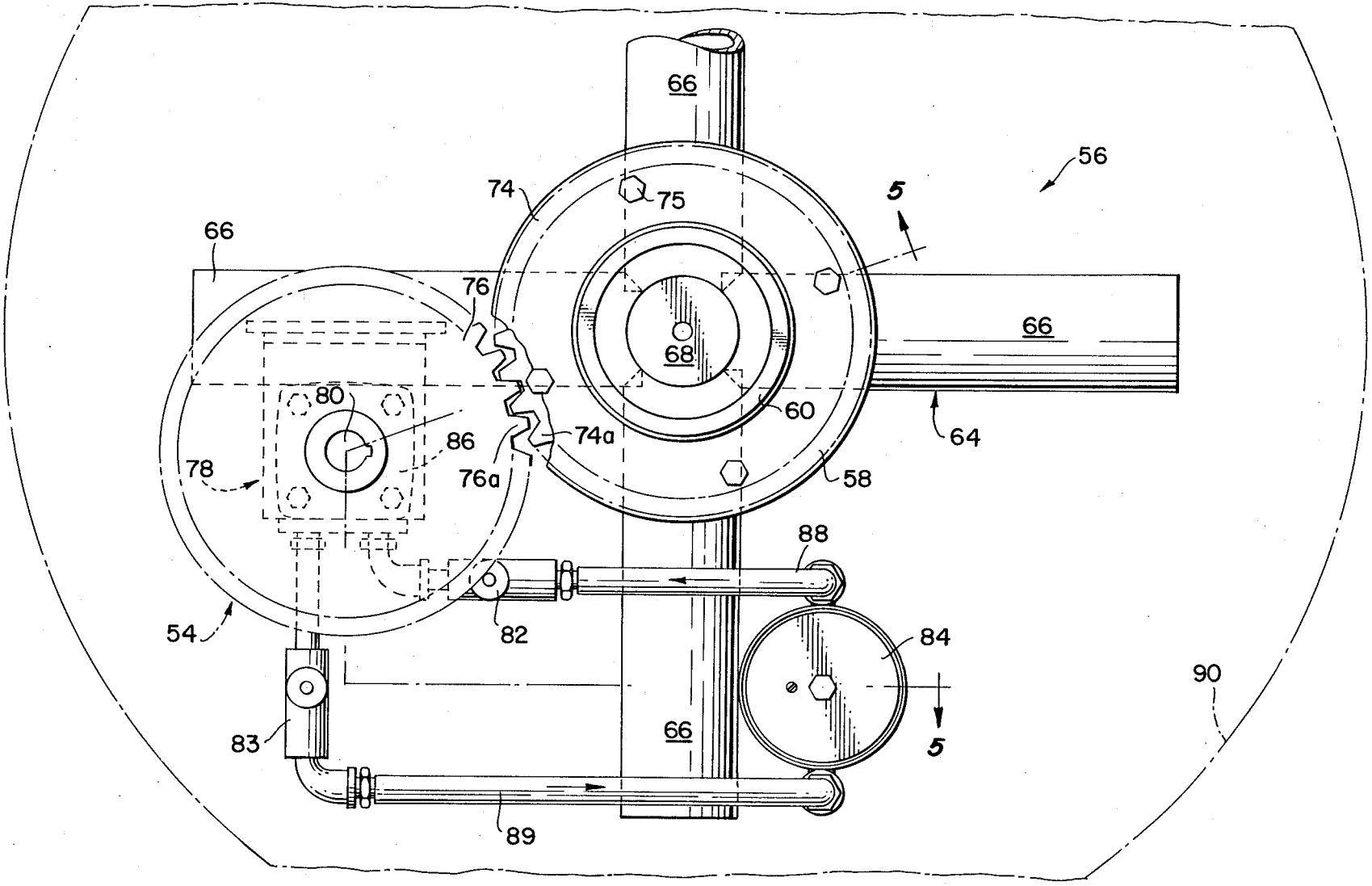
FIG. 4 is a fragmentary top plan view of a second embodiment of the present invention.
Figure 5:
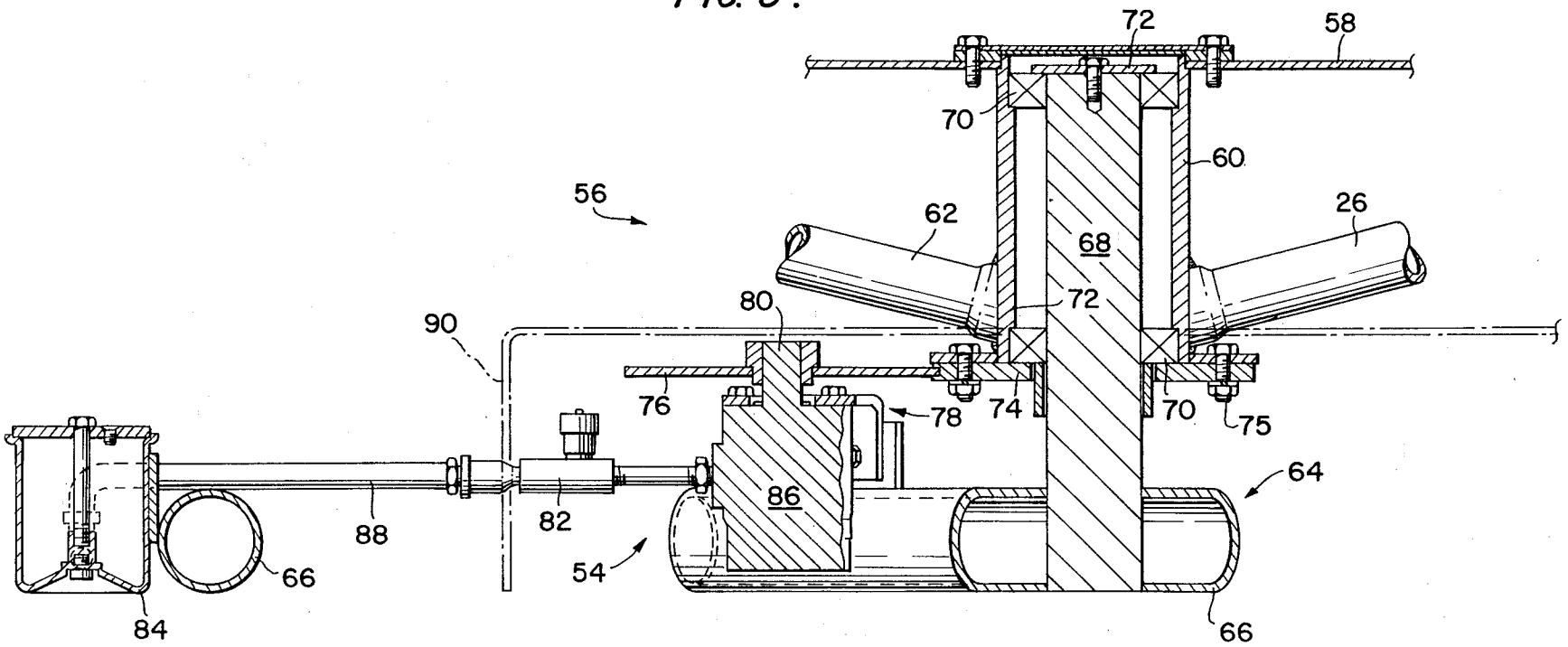
FIG. 5 is a cross-sectional view taken along line 5—5 of FIG. 4.
Figure 6:
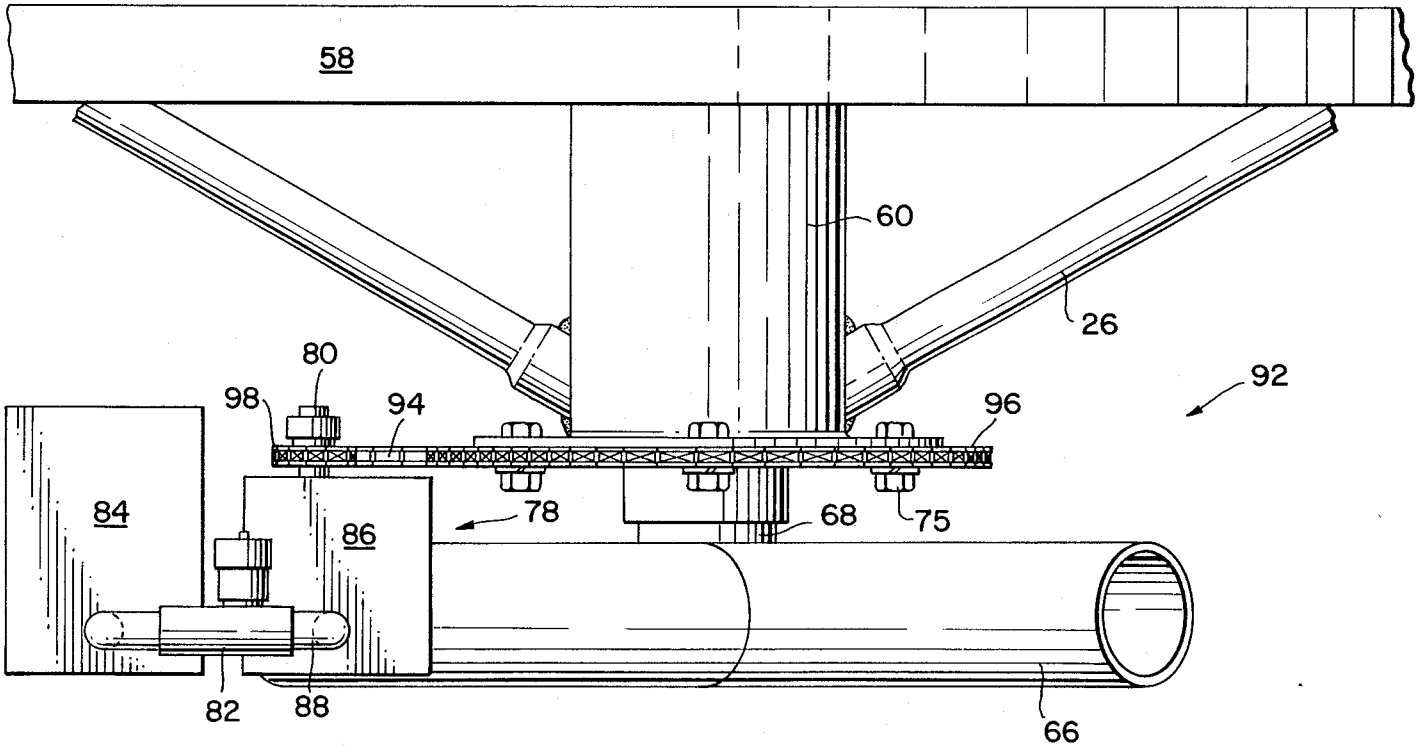
FIG. 6 is a fragmentary side elevational view of a third embodiment of the present invention.

Referring to the drawings, it is seen that FIGS. 1 through 3 illustrate a first embodiment of the present invention wherein a mechanical type of brake is employed on the rotating playground equipment assembly, FIGS. 4 and 5 illustrate a second embodiment of the present invention wherein a hydraulic brake is employed, and FIG. 6 illustrates a variation on the second embodiment wherein a chain-type connection is provided for the hydraulic brake.

Referring to FIGS. 2 and 3, it is seen that the present piece of rotating playground equipment assembly shown generally at 10 comprises a whirl platform assembly 12 which is generally circular in its top plan view and is configured and dimensioned to support one or more occupants. A soft, resilient surface, not concrete or asphalt, should be placed under whirl platform assembly 12, extending at least six feet in all directions. Whirl platform assembly 12 can include suitable handles (not shown) and a dimpled slip resistant surface (not shown). A whirl hub 14 is secured to the lower portion of whirl platform assembly 12, extends downward therefrom, and forms the lower part thereof. As has been shown in FIG. 3, hub 14 has an upright hollow cylindrical shape. A base assembly, shown best in FIG. 1 generally at 16, supports the entire assembly 10, and includes four horizontal radial support legs 18. Secured firmly to the legs 18 and extending up from their center is the spindle 20, which as best shown in FIG. 3, extends up through hollow hub 14. Hub 14 rotates about spindle 20 on bearings 22 positioned therebetween. Suitable structure 24 is provided to keep bearings 22 in place between hub 14 and spindle 20. An outer hub wheel 26 is secured to the outside of the lower end of the whirl hub 14. In top plan view, it has a circular configuration defined by its outer vertical edge 28.

A pressure wheel 30 is mounted by a pressure wheel mounting assembly shown generally at 32 for rotation about a vertical axis and so that it applies constant frictional pressure against edge 28. The pressure wheel 30 can be made from a gray iron casting with a urethane tire on its outside surface. Pressure wheel mounting assembly 32 includes a support yoke 34 having a vertically disposed pin 36 which passes through pressure wheel 30 and supports the wheel. A horizontal bar 38 is attached at one end to yoke 34 and passes through openings in upright supports or stanchions 40 and 42. Upright supports 40, 42 are firmly secured to the top of one of the radial support legs 18. Also attached to yoke 34 is a lower bar 46 passing through a second lower opening in upright support 42. This lower bar 46 which is spaced directly below horizontal bar 38 prevents the rotation of support yoke 34 about the longitudinal axis of horizontal bar 38. A compression spring 48 surrounds horizontal bar 38 and biases against upright support 40 and an adjustable nut 50, which is threaded on threads 52 on horizontal bar 38. Compression spring 48 forces against the adjustable nut 50 urging pressure wheel 30 against the outer hub wheel edge 28. This causes a rolling frictional contact between the two wheels thereby exerting a constant braking or load on the rotation of whirl platform assembly 12. This creates an increasing physical effort needed to turn as one tries to go faster. It further limits the high centrifugal forces produced at the rim of the whirl platform assembly 12. Horizontal bar 38 is provided with threads 52 along which adjustable nut 50 can be threaded to vary the pressure compression spring 48 exerts on pressure wheel 30. The spring can be of any suitable size, for example, an 11/16 inch inner diameter by a 1¼ inch outer diameter by a 3 inch length rectangular wire construction can be used such as that manufactured by Danly Machine Corporation of Olive Branch, Miss. The brake is fully enclosed and concealed in a whirl base housing or shield 53, best shown in FIG. 2.

FIGS. 4 and 5 illustrate a second embodiment of the present invention using a hydraulic braking system, which is shown generally at 54. This rotating playground equipment assembly 56 includes a similar whirl platform assembly 58 and a whirl hub 60 mounted thereto and a part thereof. Suitable bracing members 62 are connected at the lower end of hub 60 and to the outer ends of whirl platform assembly 58. The support base 64 having four radial support legs 66 similarly supports the spindle 68 in the middle thereof. Bearings 70 are positioned between spindle 68 and the interior of the whirl hub 60 and the whirl hub rotates about and on these bearings. Suitable structure 72 is provided to keep bearings 70 in position therebetween. A drive gear 74 is secured via bolts 75 to the lower end of the hub 60 and it has teeth **74*a* which engage with the teeth 76*a* of the driven gear 76, which comprises part of hydraulic braking system 54. Driven gear 76 in turn drives the hydraulic pump assembly shown generally at 78 through its hydraulic pump drive shaft 80. Hydraulic pump assembly 78 is also mounted to one of radial support legs 66. Rotation of driven gear 76 drives the hydraulic pump which has been preset to create a load against the rotation of drive gear 74 thereby effectively controlling the speed that whirl platform assembly 58 can be rotated. The load is created by fixed capacity valves 82, 83 with ¾ quart capacity reservoir 84 providing hydraulic fluid to the closed system. The pump 86 of hydraulic pump assembly 78 is bi-directional with valves 82, 83** free flow in one direction and restricting the flow of fluid in the opposite direction.

Hydraulic braking system 54 is a true speed limiter in that only so much oil can be pushed through the restricting valves 82, 83 in one direction. Pump 86 is capable of moving only so much oil and any attempt to rotate faster causes fluid by-pass within the pump. The system is closed since the pump 86 is bi-directional and valves 82, 83 are loaded in one direction and free flow in the other. This unit, as well as the mechanical brake previously described, provide a rapid slowing of rotation after the rotating forces have ceased. It is anticipated that hydraulic braking system 54 will be set to limit the rotation of the whirl platform assembly 58 to about thirty revolutions per minute, and will effectively stop the rotation in about 3 revolutions. The hydraulic pump assembly is a closed hydraulic system, and the lines 88, 89 to and from reservoir 84 are positioned at a suitable level below the top of the oil level to prevent air from entering the system. As previously described, rotation of the drive gear 74 fixed to the whirl drives the driven gear 76 fixed to the pump shaft 80. Pump rotation in one direction pulls oil from the reservoir through one line in the direction shown through the free flow side of the valves. The pump moves the oil out through the pressure side of the valves 82, 83 and the other line in the direction shown and returns it to the reservoir 84. The pump is bi-directional so that reversal of rotation reverses the action through lines 88 and 89. The pump can be any suitable pump such as that manufactured by ADM Model No. ADM50-4, and valves 82, 83 can be any suitable valves such as that manufactured by Parker Hannifin, Model. No. F6005-1 (with a one pound spring). As the rotational speed increases, the pressure approaches the pressure capacity and/or the gallons per minute flow capability of the valve, which precludes faster rotation and the oil then recirculates within the pump. A suitable shield or housing 90 enclosing the hydraulic braking system 54 is provided for safety purposes as well as to prevent the influx of dirt, stone and other particles into the system.

The rotating playground equipment assembly shown generally at 92 of FIG. 6 shows an alternative to that of FIGS. 4 and 5 and provides a chain drive connection 94 between the drive gear 96 and the driven gear or sprocket 98 as opposed to the direct gear teeth connections **74*a* and 76*a*. Assemblies 56 and 92 are designed with their pump construction to have no parts that can wear out. It is expected though that assembly 56 will be cheaper and easier to maintain than assembly 92. Assembly 92 similar to assembly 56** limits the speed at which the assembly can turn and more rapidly slows the rotation once the rotating forces have ceased making for a safer and more enjoyable rotating playground equipment assembly or whirl.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A rotating user-propelled playground equipment assembly comprising:

an equipment support base, a substantially vertical spindle secured to said support base, a rotatable platform assembly supported at least in part by said support base, said rotatable platform assembly including a substantially vertical hub assembly rotatable about said spindle, a pressure wheel rotatable about a rotation axis and positioned to rollingly engage said hub assembly, and said support base including an urging means connected to said pressure wheel for urging said pressure wheel into rolling engagement with said hub assembly and biasingly urging said rotation axis towards said hub assembly and thereby automatically retarding the rotation of said rotatable platform assembly about said spindle.

2. The equipment assembly of claim 1 including,
a mounting means attached to said pressure wheel for mounting said pressure wheel for rotation about a vertical axis.

3. The equipment assembly of claim 1 including,
said urging means including a compression spring adapted to biasingly urge said pressure wheel towards said hub assembly.

4. The equipment assembly of claim 3 including,
said urging means including an adjusting means associated with said compression spring for selectively adjusting the tension of said compression spring and thus the pressure said pressure wheel exerts against said hub assembly.

5. The equipment assembly of claim 3 including,
said urging means including a horizontal bar passing through said compression spring, an upright support, said horizontal bar passing through an opening in said upright support, a support yoke secured to said bar and supporting said pressure wheel, an abutment member secured to said horizontal bar between said upright support and said support yoke, and said compression spring contacting said abutment member and pushing against said upright support thereby urging said horizontal bar and thus said pressure wheel towards said hub assembly.

6. The equipment assembly of claim 5 including,
said bar having a central threaded portion and said abutment member comprising an adjustment nut adapted to screw along said central threaded portion and thereby selectively vary the compression of said compression spring.

7. The equipment assembly of claim 5 including,
said urging means further including a second upright support positioned at a distance from said upright support, having an opening through which said horizontal bar freely passes, and positioned between said compression spring and said pressure wheel.

8. The equipment assembly of claim 5 including,
said abutment member comprising an adjustment nut threaded along said horizontal bar and positionable against the end of said compression spring closest to said pressure wheel.

9. The equipment assembly of claim 1 including,
said hub assembly including an outer hub wheel, and said pressure wheel being positioned to directly engage said outer hub wheel.

10. The equipment assembly of claim 9 including,
said hub assembly including an upper hub assembly portion positioned above said outer hub wheel, and said outer hub wheel having a diameter greater than that of said upper hub assembly.

11. The equipment assembly of claim 10 including,
a housing extending beyond said hub assembly and covering said outer hub wheel, and said pressure wheel, and having its upper surface positioned below said rotatable platform assembly.

12. The equipment assembly of claim 1 including,
said urging means urging said pressure wheel into constant frictional contact with said hub assembly.

13. The equipment assembly of claim 1 including,
said pressure wheel being rotated about a vertical axis solely by the rotation of said hub assembly by the rotation of said rotatable platform, assembly against it.

14. The equipment assembly of claim 1 including,
said pressure wheel rotating about a vertical axis, and
a blocking means connected to said pressure wheel and associated with said support base for blocking the rotation of said vertical axis generally about the longitudinal axis of said horizontal bar.

15. The equipment assembly of claim 1 including,
said spindle being vertically positioned.

16. The equipment assembly of claim 1 including,
said equipment support base being substantially horizontal.

17. The equipment assembly of claim 16 including,
said equipment support base being horizontal.

18. The equipment assembly of claim 1 including,
said rotatable platform assembly being supported at least in part by said spindle.

19. The equipment assembly of claim 18 including,
said rotatable platform assembly being supported by said spindle.

20. The equipment assembly of claim 1 including,
said hub assembly being vertically disposed.

21. The equipment assembly of claim 20 including,
said support base including a substantially horizontal support portion.

22. The equipment assembly of claim 21 including,
said urging means being connected to and supported by said substantially horizontal support portion.

23. The equipment assembly of claim 9 including,
said pressure wheel engaging the circumferential surface of said outer hub wheel.

24. The equipment assembly of claim 1 including,
said hub assembly comprising a lower portion of said rotatable platform assembly.

25. The equipment assembly of claim 1 including,
said hub assembly defining a sleeve in which said spindle is positioned.

26. The equipment assembly of claim 1 including,
said rotatable platform assembly being user rotatably propelled.

27. The equipment assembly of claim 1 including,
said spindle being fixed to said support base.

28. The equipment assembly of claim 1 including,
said hub assembly being positioned directly radially outside of and concentric to said spindle.

29. The equipment assembly of claim 1 including,
said rotatable platform assembly being supported in its entirety by said support base.

30. A rotating user-propelled playground equipment assembly comprising:
a substantially horizontal equipment support base,
a substantially vertical spindle secured to said support base,
a rotatable platform assembly supported by said spindle,
said rotatable platform assembly including a substantially vertical hub assembly rotatable about said spindle,
a pressure wheel positioned to rollingly engage said hub assembly, and
said support base including an urging means connected to said pressure wheel for urging said pressure wheel towards and into rolling engagement with said hub assembly and thereby automatically retarding the rotation of said rotatable platform assembly about said spindle.

31. A rotating user-propelled playground equipment assembly comprising:
an equipment support base, a spindle secured to said support base, a rotatable platform assembly supported at least in part by said support base, said rotatable platform assembly including a substantially vertical hub assembly rotatable about said spindle, a pressure wheel rotating about a vertical axis and positioned to rollingly engage said hub assembly, said support base including an urging means connected to said pressure wheel for urging said pressure wheel into rolling engagement with said hub assembly and thereby automatically retarding the rotation of said rotatable platform assembly about said spindle, said urging means including a compression spring adapted to biasingly urge said pressure wheel towards said hub assembly, and a blocking means connected to said pressure wheel and associated with said support base for blocking the rotation of said vertical axis generally about the longitudinal axis of said horizontal bar.

* * * * *